US005573168A

United States Patent [19]

Kannankeril et al.

[11] Patent Number: 5,573,168

[45] Date of Patent: Nov. 12, 1996

[54] DISPENSER FOR PLASTIC BAGS

[75] Inventors: Charles P. Kannankeril, North Caldwell, N.J.; Bruce A. Cruikshank, Wilton, Conn.

[73] Assignee: Sealed Air Corporation, Saddle Brook, N.J.

[21] Appl. No.: 175,292

[22] Filed: Dec. 29, 1993

[51] Int. Cl.[6] ..... B26F 3/02

[52] U.S. Cl. ..... 225/106; 225/46; 225/54; 225/79; 225/80; 225/88; 225/90

[58] Field of Search ..... 225/46, 52, 53, 225/54, 79, 80, 82, 88, 90, 106, 23, 72, 73; 226/196; 242/566, 615.3

[56] References Cited

U.S. PATENT DOCUMENTS

| | | | |
|---|---|---|---|
| 1,122,673 | 12/1914 | Winter et al. | 225/106 |
| 2,349,635 | 5/1944 | Pusheck | 225/85 |
| 2,477,014 | 7/1949 | Stanley et al. | 248/223.41 |
| 2,597,602 | 5/1952 | Sipior | 225/19 |
| 3,045,883 | 7/1962 | Andrews et al. | 225/90 |
| 3,050,224 | 8/1962 | Drolshammer | 225/38 |
| 3,098,594 | 7/1963 | Williamson | 225/48 |
| 3,229,876 | 1/1966 | Osborn, Jr. | 225/49 |
| 3,291,354 | 12/1966 | Ziebarth | 225/106 X |
| 3,510,033 | 5/1970 | Schramm et al. | 225/77 |
| 3,982,659 | 9/1976 | Ross | 221/63 |
| 4,289,262 | 9/1981 | Finkelstein | 225/106 |
| 4,424,926 | 1/1984 | Gatward | 225/46 X |
| 4,714,191 | 12/1987 | Richardson | 229/121 |
| 4,793,539 | 12/1988 | Haenni et al. | 225/106 |
| 5,024,349 | 6/1991 | Haenni et al. | 221/46 |
| 5,097,998 | 3/1992 | Shimasaki | 225/106 |
| 5,118,022 | 6/1992 | Farahnik | 225/106 |
| 5,135,134 | 8/1992 | Dancy | 221/61 |
| 5,135,146 | 8/1992 | Simhaee | 225/80 |
| 5,170,957 | 12/1992 | Carpenter | 242/55.53 |
| 5,207,368 | 5/1993 | Wilfong, Jr. et al. | 225/106 |
| 5,219,424 | 6/1993 | Simhaee | 225/47 |
| 5,363,997 | 11/1994 | Harris | 225/25 |

FOREIGN PATENT DOCUMENTS

| | | |
|---|---|---|
| 413664 | 8/1910 | France . |
| 398106 | 9/1933 | United Kingdom . |
| 587290 | 4/1947 | United Kingdom . |
| 2088330 | 6/1982 | United Kingdom . |

*Primary Examiner*—Eugenia Jones
*Assistant Examiner*—Raymond D. Woods
*Attorney, Agent, or Firm*—Bell, Seltzer, Park & Gibson P.A.

[57] ABSTRACT

A dispensing apparatus for serially dispensing plastic bags from a wound roll of continuous flexible plastic bags joined along perforated severance lines. A box like container is provided which is adapted to receive the wound roll of plastic bags. The container has a bottom panel, a top panel, a rear panel, a front panel, and a pair of opposed side panels. The front panel defines a guide slot for guiding the plastic bags from the wound roll along a predetermined path and further defining a threading slide for threading the plastic bags from the wound roll into the guide slot. A separation tongue is located on the front panel for separating the plastic bags from the wound roll as the plastic bags engage the separation tongue along a predetermined path of travel.

23 Claims, 3 Drawing Sheets

DISPENSER FOR PLASTIC BAGS

FIELD OF THE INVENTION

The present invention relates to a dispensing apparatus adapted for serially dispensing plastic bags from wound rolls which are joined along perforated severance lines.

BACKGROUND OF THE INVENTION

Supermarkets or food markets are currently displaying fruits and vegetables in bulk, enabling consumers to inspect the quality of the fruits and vegetables and individually select the desired items. The fruits and vegetables are displayed in their original shipping containers, loosely arranged in display bins or, when appropriate, stacked into piles.

Plastic produce bags are usually provided to hold the selected fruits and vegetables. Normally, the plastic bags are cylindrically wound rolls which are placed either horizontally or vertically on a fixed shaft having one end thereof mounted on a stand. The stands are usually conveniently located throughout the produce department. The bags on the wound rolls are separated by perforated severance lines which allow the plastic bags to be serially dispensed from the wound roll.

To take a bag from the wound roll, the consumer must grab the end bag with one hand while holding the next bag and/or the wound roll with the other and then pull with sufficient force to separate the end bag from the wound roll along the severance line. In so doing, the customer often not only separates the end bag from the wound roll, but also deforms or tears the end bag depending upon the amount of force used.

The consumer occasionally has one hand occupied holding the selected fruits or vegetables or some other item which precludes using both hands to separate the end bag from the wound roll. When this happens, the consumer usually attempts to jerk the bag from the wound roll without holding the adjacent bag and/or the wound roll. This usually results in damage to the end bag and/or causes the wound roll to over spin. This free spinning of the wound roll about the fixed shaft causes an excessive number of bags to be reeled from the wound roll. These unwanted bags must then be rewound onto the wound roll or separated therefrom resulting in possible damage and/or waste. Furthermore, after the end bag has been removed from the wound roll, it may be difficult to find the next bag because the next bag will likely lie flush against the wound roll.

The purpose of providing produce bags adjacent the fruits and vegetables in the produce department is to assist consumers with packaging of the selected items. To properly assist consumers it is helpful to provide a plastic bag dispenser which allows only one bag to be dispensed at a time.

One approach to serially dispensing plastic bags may be seen in U.S. Pat. No. 5,219,424 and related U.S. Pat. No. 5,135,146 to Simhaee which disclose a dispenser having a tongue which engages the separation line between the bag at the end of the wound roll and the next bag. A finger is provided on the upstream side of the tongue with a gap being formed between the finger and the tongue such that as the bag is separated, a portion of the front edge of the next bag is held in the gap, thereby holding the bag in position for the next user. However, in this configuration, there is no provision for ensuring that the plastic bag is guided from the wound roll into contact with the tongue and thereby ensuring contact of the severance line with the tongue for separation of the end bag from the wound roll along the severance line.

In addition, existing devices do not have provision for enabling the quick threading of a replacement wound roll into the container.

SUMMARY OF THE INVENTION

In view of the foregoing background, it is therefore an object of the present invention to provide an improved dispensing apparatus for serially dispensing plastic bags.

This object and other objects, features and advantages of the present invention are obtained by providing a dispensing apparatus for serially dispensing flexible plastic bags from a wound roll of continuous bags joined along perforated severance lines. A box-like container is provided to receive the wound roll of plastic bags. The container includes a pair of side panels which are located opposite each other. A rear panel is provided which extends between the pair of side panels and a front panel is located opposite the rear panel. A bottom panel is also provided which has a generally planar surface for supporting the wound roll.

A separating means is preferably located on the container to engage the severance line of the plastic bags and separate the end plastic bag from the next bag on the wound roll to provide for serial dispensing of the plastic bags.

The container preferably has a guide means located thereon or attached thereto for guiding the plastic bags from the wound roll toward the separating means to ensure that the plastic bags travel in the proper direction so that the severance line travels over the separation means providing easy separation of the end bag from the wound roll.

A threading means is preferably located on or attached to the container for threading the plastic bags from the wound roll received in the container into the guide means. The threading means provides for easy threading of a new or replacement wound roll into the guide slot.

In the preferred embodiment, the separating means comprises a tongue formed on the guide plate which is shaped to easily engage the severance line located between the plastic bags.

The threading means preferably comprises a cutaway section of the front panel for directing the advancing plastic bags into the guide means to allow for easy dispensing of the plastic bags.

The guide means preferably comprises a guide slot formed in the guide plate which extends generally horizontally outward from the front plate. The guide slot is sized to accommodate the plastic bags and communicates with the threading means at an opening located between the guide means and the threading means allowing the plastic bags to travel down the threading means and into the guide means.

The containers may also include a top panel which is pivotally connected to the side panels and which may be weighted to frictionally bear against the wound roll. The top panel may also include an underside having a frictional material for enhancing the frictional contact with the wound roll to prevent free spinning thereof when the wound roll is rotated by advancement of the plastic bags. In addition the top panel preferably contains an angled end to provide additional friction against over spinning of the wound roll, especially when only a few bags remain on the wound roll.

The separating means is preferably located slightly above a horizontal axial alignment with the guide means to ensure that the separating means contacts the severance line of the plastic bags at the desired location.

BRIEF DESCRIPTION OF DRAWINGS

Some of the objects and advantages of the present invention having been stated, others will appear as the description proceeds, when taken in conjunction with the accompanying drawings, in which.

DESCRIPTION OF THE ILLUSTRATED EMBODIMENT

The present invention will now be described more fully hereinafter with reference to the accompanying drawings, in which the preferred embodiment of the invention is shown. This invention may, however, be embodied in many different forms and should not be construed as limited to the embodiments set forth herein. Rather, the illustrated embodiment is provided so that this disclosure will be thorough and complete, and will fully convey the scope of the invention to those skilled in the art. Like numbers refer to like elements throughout.

Figure 1:
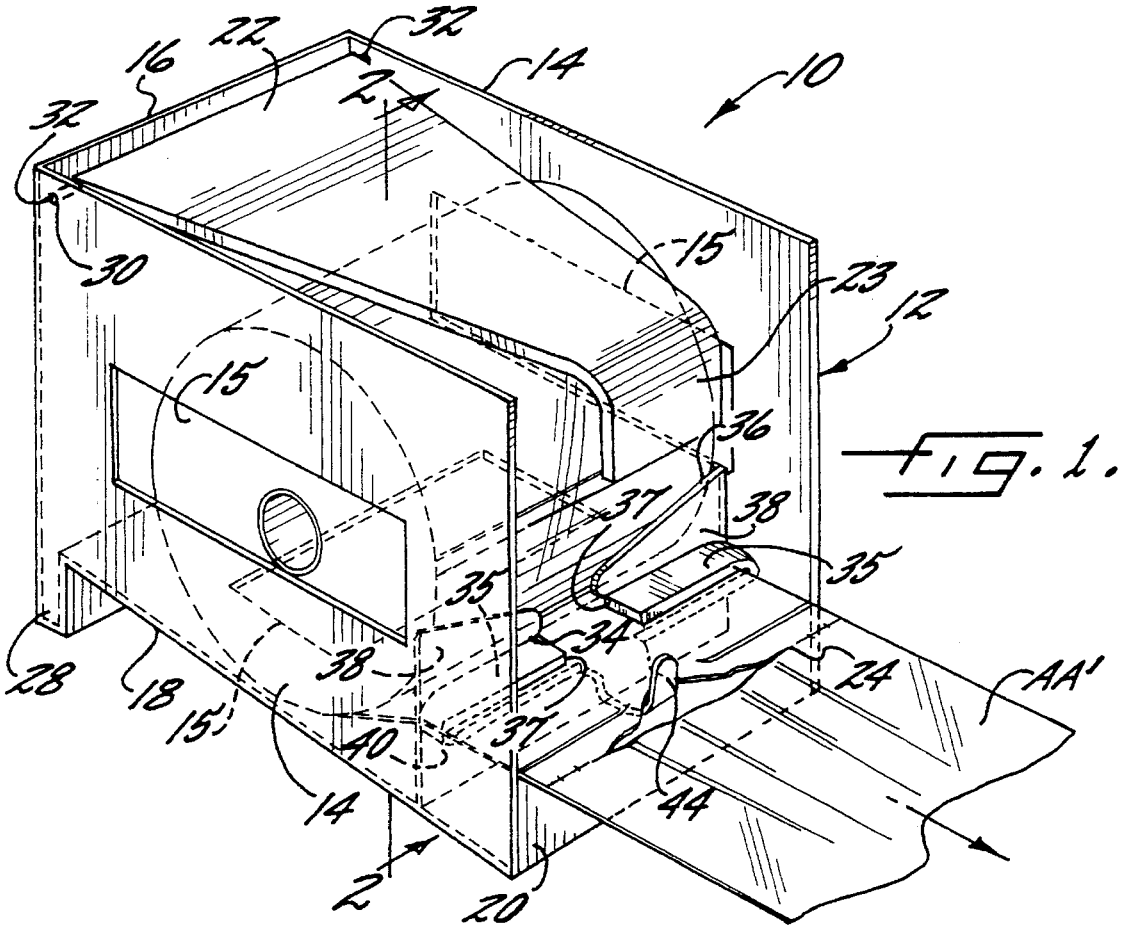
FIG. 1 is a perspective view of a dispensing apparatus for plastic bags in accordance with the present invention.
Figure 2:
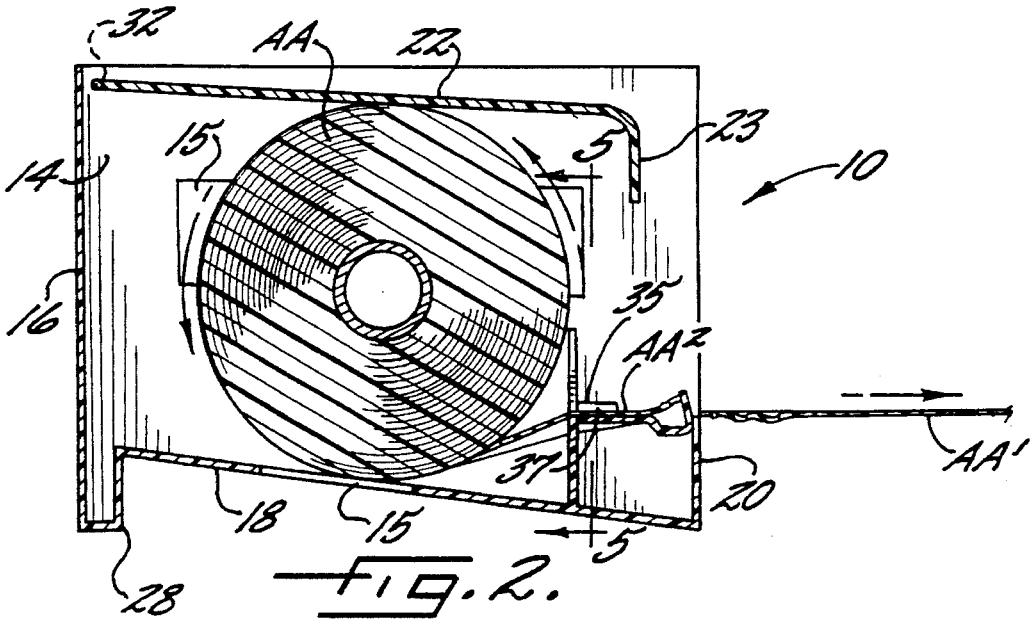
FIG. 2 is a cross-sectional view taken along line 2—2 of FIG. 1.

Referring to FIGS. 1 and 2, the apparatus of the present invention is illustrated generally at 10. The apparatus 10 includes a container, generally indicated at 12, which includes a pair of opposed side panels 14, a rear panel 16, located between the pair of side panels 14, a bottom panel 18, a front panel 20, located opposite the rear panel 16, and a top panel 22, located opposite the bottom panel 18.

The container 12 is adapted to receive a wound roll of plastic bags AA, which is formed of a continuous roll of flexible plastic bags AA joined along perforated severance lines 24. The plastic bags AA are intended for use as produce bags in supermarkets or food markets, for carrying fruit and\or vegetables. It is to be understood however, that the apparatus 10 may be utilized for dispensing plastic bags AA from a wound roll for any particular use while remaining within the spirit of the invention. The container 12 has a generally rectangular or box-shape configuration which corresponds in size to the wound roll of plastic bags AA to be received.

Figure 9:
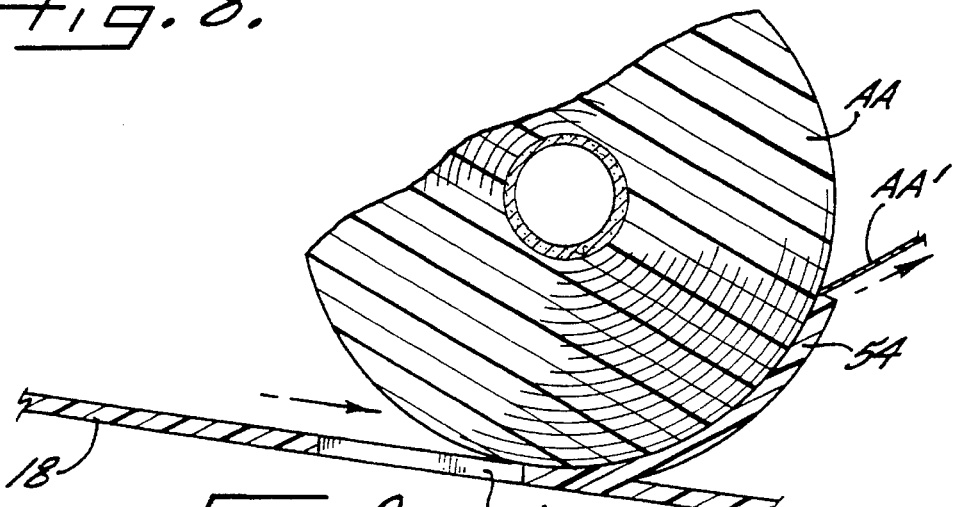
FIG. 9 is a fragmentary side view showing a wound roll cooperating with a bottom support for supporting the wound roll in accordance with an alternative embodiment of the present invention.

As may be best seen in FIGS. 1, 2 and 9, the bottom panel 18 which has a generally planar surface to support the wound roll and is inclined away from the front panel 20 to locate or position the wound roll adjacent the front panel 20. The pitch of the incline of the bottom panel 18 is such that the wound roll is discouraged or prevented from travelling up the incline as the wound roll unwinds due to advancement of the plastic bags AA out of the container 12.

The pair of opposed side panels 14 have a generally rectangular shape which cooperates with the bottom panel 18 to limit lateral movement of the wound roll as it is unwound. The side panels extend a sufficient distance upward from the bottom panel 18 to contain the wound roll. The bottom panel 18 and the opposed side panels 14 each have cutouts 15 to reduce the overall weight of the container 12 as well as prevent any foreign objects from collecting inside the container 12. In the present embodiment, the cutouts 15 are generally rectangular. It is to be understood however, that the cutouts 15 may take any shape desired so long as the above-referenced purposes are met.

As illustrated in FIGS. 1–5, the rear panel 16 has a generally square shape. The rear panel is positioned and extends between the pair of opposed side panels 14. A leg 28 is formed where the side panels, the rear panel 16, and the bottom panel 18 meet. The purpose of the leg 28 is to incline the bottom panel 18 of the container 12 the desired amount.

The opposed side panels 14, the rear panel 16, the bottom panel 18, and the front panel 20, are integrally interconnected or fixedly attached to one another by an adhesive material to form the box-like container 12. The container 12 may also be formed by injection molding as an integral unit, by thermo forming or a similar manufacturing process in accordance with the spirit of this invention.

In this embodiment, the top panel 22 is pivotally mounted to the opposed side panels 14 of the container 12 so that the top panel 22 may pivot relative to the container either toward or away from the bottom panel 18. The top panel is capable of pivoting away from the bottom panel 18 to allow a new wound roll to be received within the container 12. As shown in FIGS. 1 and 2 the top panel 22 has an end piece 23 which is bent downward toward the bottom panel at an angle of approximately 90° to create additional drag or resistance to overspin as the diameter of the roll decreases in size due to a reduction in the number of bags remaining on the roll. This occurs because the top panel 22 is capable of pivoting in a downward direction toward the bottom panel to allow the top panel to remain in constant contact with the wound roll to restrain or prevent over spinning thereof during advancement of the plastic bags AA.

The wound roll as shown in FIGS. 1, 2, 8, and 9, is inserted into the container such that the plastic bags AA wind from the bottom of the wound roll. The wound roll of this embodiment does not need to be mounted on an axle located within the container. Rather, for ease of use, the wound roll is simply placed within the container and allowed to rotate freely. If desired, an axle may be located within the container to rotationally support the wound roll. It is also possible to place the wound roll within the container so that the plastic bags AA unwind from the top of the wound roll.

In an alternative embodiment, it is possible to secure a rubberized material, or treat the underside of the top panel 22 with a rubberized material to increase the friction between the underside of the top panel and the wound roll to ensure a controlled unwinding of the plastic bags AA. Alternatively, rather than a rubberized material, the under side of the top panel 22 may be treated with other materials or provided with a textured surface to achieve the desired frictional surface. It may also be desirable to have a top panel 22 which is weighted to provide additional friction against the wound roll and ensure that the top panel remains in constant frictional contact with the wound roll as it unwinds.

In the embodiment shown in FIGS. 1 and 2, the pair of side panels 14 each define a mounting aperture 30 which corresponds to a mounting pin 32 located on each side of the top panel 22. The mounting pins 32 are seated within the mounting apertures 30 to pivotally secure the top panel within the container 12. It is also possible to pivotally mount the top panel 22 to the rear panel 16 while remaining within the spirit of the invention.

Figure 3:
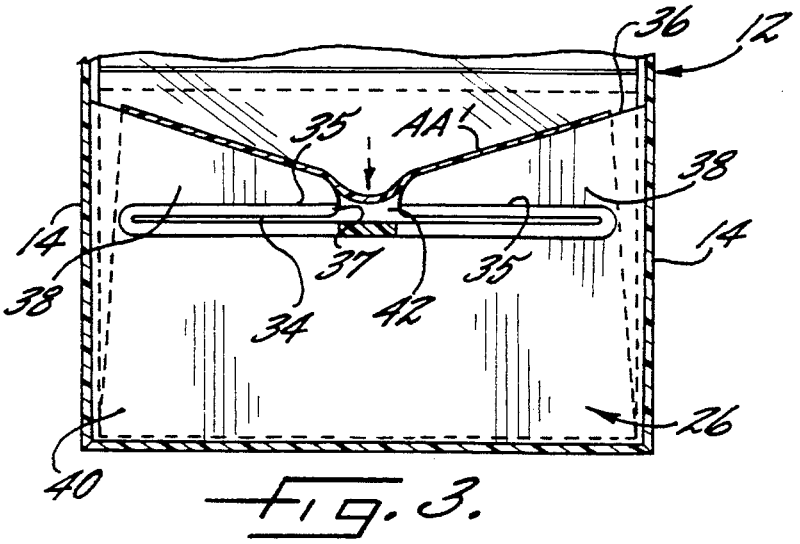
FIG. 3 is an end view showing a plastic bag being fed along a threading slide in accordance with the present invention.
Figure 4:
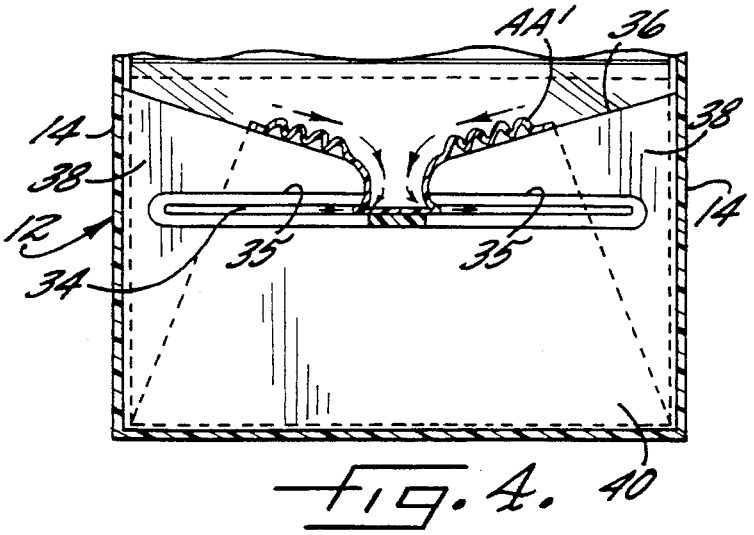
FIG. 4 is an end view similar to that shown in FIG. 3 illustrating a plastic bag being threaded into a guide slot in accordance with the present invention.
Figure 5:
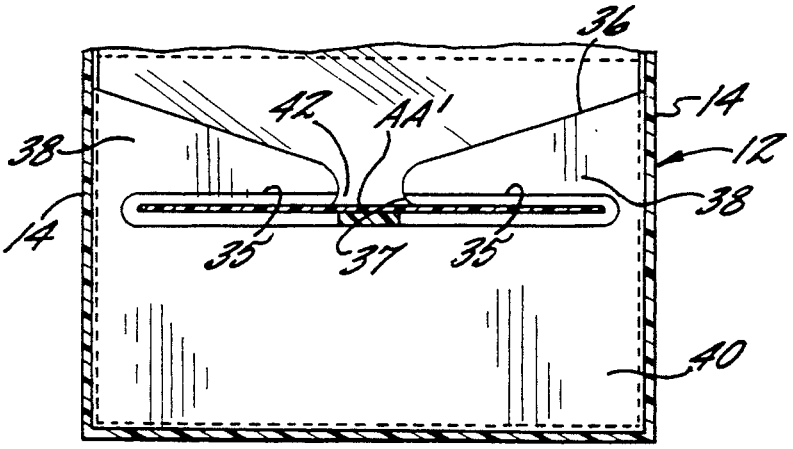
FIG. 5 is a front end view taken along the line 5—5 of FIG. 2 showing a plastic bag having been threaded along the threading slide into the guide slot in accordance with the present invention.

As illustrated in FIGS. 1–5, the front panel 20 has a generally rectangular configuration. The front panel 20 is affixed to the bottom panel 18 and extends between the opposed side panels 14. The upper surface of the front panel 20 is cut away to form two opposed side protrusions 38. The two opposed side protrusions 38 each have a generally triangular shape (as best shown in FIGS. 3–5) such that the side protrusions are each attached to their respective side panel 14 at a base of their triangular shape. Rather than a pointed apex to the triangular shape, the opposed side protrusions have a rounded apex, the purpose of which is described below in greater detail. Between the opposed side protrusions 38, is an opening or space 42, which allows the advancing plastic bags AA to easily pass therebetween, as will be described in greater detail below. The upper surface of the side protrusions 38, which form the sides of the triangular shape, combine to form the threading means or threading slide 36.

A guide plate 35 is attached to the front panel 20 and extends outward therefrom generally transverse or perpendicular to the front panel 20. The guide plate 35 has a generally U-shaped configuration with a pair of free ends 37 bent back toward each other, on top of the guide plate 35. A horizontally oriented channel forms a guide slot 34 which extends the entire distance of the guide plate 35. The free ends 37 extend toward each other the same distance as the opposed side protrusions 38 such that space 42 extends to the end of guide plate 35. The threading slide 36 is located above and in vertical alignment with the guide slot 34, such that the opening 42 is located therebetween.

The lower surface of the guide plate is shaped to form separating means or a tongue 44. The tongue 44 has a generally hook-shaped configuration which extends generally outward from the lower portion of the guide plate 35 and in horizontal alignment therewith. The actual hook of the tongue 44 projects upward from the lower portion of the guide plate 35 and is positioned slightly above an axial alignment with the guide slot 34. Although not described in detail, it is possible to have a separating means which is generally in horizontal axial alignment with the guide slot and remain within the spirit of the invention so long as the orientation between guide slot and separating means enables engagement with the severance line for easy separation of the end bag from the wound roll.

In operation the top panel 22 is pivoted upward away from the bottom panel 18 to allow the container 12 to receive a wound roll of plastic bags AA. The wound roll is inserted such that the plastic bags AA unwind from the bottom of the wound roll. As shown in FIGS. 2–5 the end bag, designated $AA^1$ is pulled upward from the bottom of the wound roll toward the front panel 20 along the threading slide 36. As the end bag $AA^1$ is pulled generally horizontally along the threading slide 36, the end bag will slide down the threading slide 36, all the while beginning to fold into itself, so as to have a generally U-shaped configuration as may be seen by comparing FIGS. 3 and 4. As the end bag $AA^1$ is continued to be pulled horizontally, the bag will slide around the rounded apex of the side protrusions 38, passed the opening 42 and free ends 37 of the guide plate 35 into the guide slot 34, as shown in FIG. 4. As the end bag advances on its predetermined path toward the tongue 44 with guide plate 35, the bag will unfold in the guide slot 34. The end bag $AA^1$ continues to be advanced until a portion of the end bag protrudes beyond the guide plate 35. At this point, the threading of the plastic bags AA is complete.

To remove the end bag $AA^1$ from the container, an individual or customer grabs the end bag with one hand and pulls the bag in a generally horizontal fashion away from the container 12. The individual continues to pull the end bag which will travel within the guide slot 34 along a predetermined direction so that the perforated severance line 24 between the end bag $AA^1$ and the next bag $AA^2$, will line up and engage the tongue 44, ensuring that the end bag will easily separate from the wound roll while advancing the next bag $AA^2$ a sufficient distance beyond the container 12 to allow for easy withdrawal. In this embodiment, the plastic bags may be removed from the container and separated from the wound roll with the use of only one hand while ensuring that the next bag $AA^2$ can be easily grasped for removal.

Figure 6:
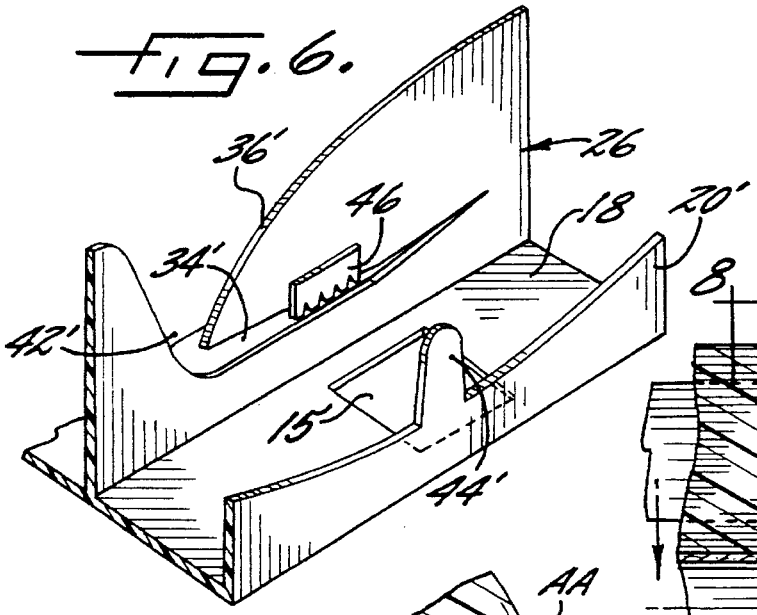
FIG. 6 is a fragmentary prospective view of a threaded slide and a guide slot having a rubber brush contacting an upper surface of the advancing plastic bag in accordance with an alternative embodiment of the present invention.

FIGS. 6–9 illustrate alternative embodiments of the present invention without departing from the spirit of the invention. FIG. 6 for example illustrates an alternative arrangement including an interior panel 26 and the front panel 20'. In this arrangement, the interior panel has a unitary construction which defines a threading slide 36' and a guide slot 34' which has an offset configuration. In this configuration, the threading slide 36' has a much steeper slide on one side of the threading slide than the other and the opening 42' is not centrally located but favors one side. The guide slot 34' is not centrally located below the opening but rather extends therefrom below the gradually inclined portion of the threading slide 36'.

A brush 46 is attached to the interior panel 26' so as to partially project into the guide slot 34'. The brush 46 is constructed of a rubberized material which provides additional friction to the plastic bags as they advance along the predetermined path. This additional friction causes the upper layer of the end bag $AA^1$, which contacts the brush, to slow down as the bottom layer of the end bag (absent the additional friction) continues along the predetermined path at the original speed. The result is that the end bag begins to open as the bottom layer of the end bag travels toward the end of the container faster than the upper layer of the bag. This enables the individual to more easily open the bag as it is separated from the wound roll.

Figure 7:
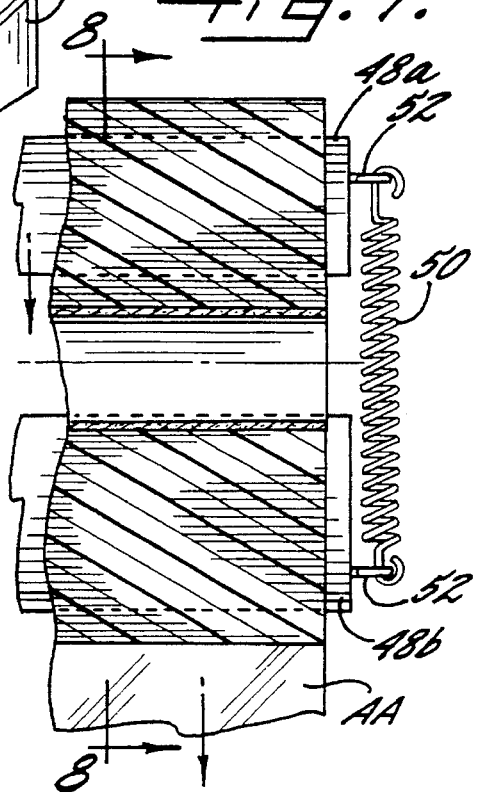
FIG. 7 is a fragmentary top plan view of a positioning means in accordance with an alternative embodiment of the present invention.
Figure 8:
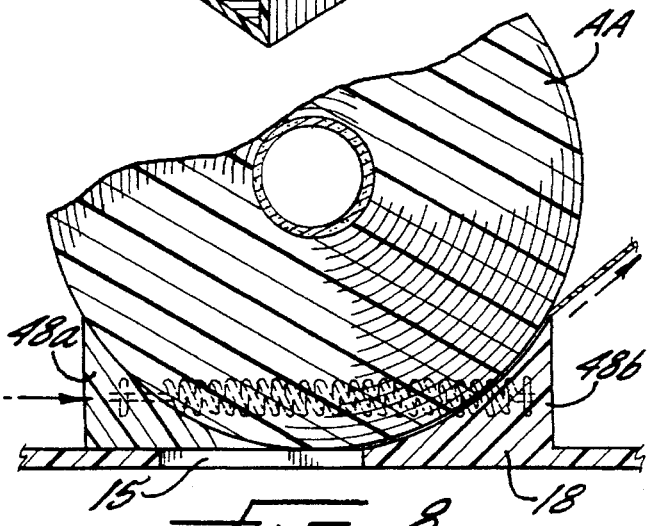
FIG. 8 is a fragmentary side view in cross-section taken along line 8—8 of FIG. 7.

FIGS. 7–9 illustrate alternative methods of positioning the wound roll on the bottom panel 18. The embodiment shown in FIGS. 7 and 8 utilizes a pair of wedges **48*a* and 48*b* to position the wound roll. Wedge 48*b* is fixed relative to the bottom panel 18 and wedge 48*a* is slidable relative thereto. A spring 50 is attached to anchoring pins 52 on each of the wedges 48*a* and 48*b* and biases the wedge 48*a* toward the wedge 48*b*** to constantly adjust the position of the wound roll, as the wound roll unwinds.

FIG. 9 has a similar bottom panel 18 configuration as in the originally described embodiment. However, in the embodiment shown in FIG. 9, a curved bottom support 54 cooperates with the inclined bottom panel 18 to assist in positioning the wound roll in the desired position. The support 54 has a generally arcuate shape which corresponds to the shape of the wound roll, allowing the wound roll to rest thereon.

Many modifications and other embodiments of the invention will come to mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. A dispensing apparatus for serially dispensing plastic bags from a wound roll of continuous flexible plastic bags, wherein adjacent plastic bags are joined along a perforated severance line, said apparatus comprising:

a container adapted to receive the wound roll of plastic bags, said container including a pair of opposed side panels, a rear panel located between said pair of side panels, a front panel located opposite said rear panel, and a bottom panel supporting the wound roll;

separating means located on said container for engaging the severance line of the plastic bags and separating the plastic bags from the wound roll;

guide means located on said container upstream of said separating means for guiding the plastic bags along a substantially confined path defining a first axis from the wound roll toward said separating means; and threading means located on said container upstream of said guide means for threading the plastic bags from the wound roll received in said container into said guide means along a second axis generally transverse to said first axis.

2. An apparatus according to claim 1 wherein said separating means comprises a tongue formed in said guide means for engaging the severance line between the plastic bags for separating the plastic bags from the wound roll.

3. An apparatus according to claim 1 wherein said threading means comprises a threading slide formed from a pair of opposed side protrusions of said front panel, each of said pair of opposed side protrusions comprises a generally triangular configuration wherein a base of each of said side protrusions is attached to a respective one of said side panels, and wherein the opposed side protrusions are laterally spaced apart to define an opening therebetween.

4. An apparatus according to claim 3 wherein said opening communicates between said threading slide and said guide means for directing the plastic bags from said threading slide into said guide means.

5. An apparatus according to claim 4 wherein said opening between said threading slide and said guide means is of sufficient size to enable the plastic bags to move easily from said threading slide into said guide means as the plastic bags are being threaded into said guide means.

6. An apparatus according to claim 1 wherein said guide means comprises a generally horizontally extending guide plate attached to said front panel, and wherein said guide plate defines a generally horizontal guide slot.

7. An apparatus according to claim 1 further comprises an interior panel extending between said side panels and located between said rear panel and said front panel, and such that the wound roll may be located between said rear panel and said interior panel.

8. An apparatus according to claim 7 wherein said interior panel further includes a brush attached thereto for contacting advancing plastic bags to assist in opening thereof.

9. An apparatus according to claim 1 wherein said bottom support located toward said front panel for supporting the wound roll in a desired position.

10. An apparatus according to claim 1 wherein said bottom panel is inclined away from said front panel for biasing the wound roll toward said front panel.

11. An apparatus according to claim 1 further including restraining means for restraining the wound roll of plastic bags from over spinning as the plastic bags are advanced toward said separating means.

12. An apparatus according to claim 11 wherein said restraining means comprises a top panel attached to said container and pivotally contacting the wound roll.

13. An apparatus according to claim 12 wherein said top panel is pivotally connected to said side panels.

14. An apparatus according to claim 13 wherein said top panel comprises an end piece connected to said top panel at an angle directed toward said bottom panel approaching 45°.

15. An apparatus according to claim 13 wherein said top panel is weighted to frictionally bear against the wound roll as it unwinds.

16. An apparatus according to claim 13 wherein said top panel includes an underside having a frictional surface for increased frictional contact with the wound roll to prevent free spinning thereof when the wound roll is rotated by advancement of the plastic bags toward said separating means.

17. An apparatus according to claim 16 wherein said frictional surface comprises a rubber-like compound.

18. An apparatus according to claim 1 wherein said separating means is located longitudinally above said guide means.

19. An apparatus according to claim 1 wherein said guide means and said separating means are generally horizontally axially aligned to ensure said separating means contacts the severance line of the plastic bags.

20. An apparatus according to claim 1 further including positioning means for positioning the wound roll in a desired position within said container.

21. An apparatus according to claim 20 wherein said positioning means comprises a pair of wedges positioned on said bottom panel and such that one of said pair of wedges is stationary and the other of said pair of wedges is spring biased toward said one of said pair of wedges to engage the wound roll therebetween in a desired position.

22. An apparatus according to claim 1 wherein said opposed side panels each define a cutout for reducing overall weight of said container.

23. An apparatus according to claim 1 wherein said bottom panel defines a cutout for reducing weight of said container and preventing waste objects from accumulating therein.

* * * * *